United States Patent [19]

Pinto et al.

[11] Patent Number: 5,072,491

[45] Date of Patent: Dec. 17, 1991

[54] HOPPER FEEDER FOR PRODUCING A MIXTURE OF FIBER, MATERIAL, IN PARTICULAR OF TEXTILE FIBER MATERIAL

[75] Inventors: Akiva Pinto, Duesseldorf; Guenter Lucassen, Haltern; Bernhard Bocht, Neubulach, all of Fed. Rep. of Germany

[73] Assignee: Hergeth Hollingsworth GmbH, Duelman, Fed. Rep. of Germany

[21] Appl. No.: 507,424

[22] Filed: Apr. 9, 1990

[30] Foreign Application Priority Data

Oct. 10, 1987 [WO] PCT Int'l Appl. .. PCT/EP8800871

[51] Int. Cl.[5] ..... D01G 23/04

[52] U.S. Cl. ..... 19/145.5; 19/975; 19/105; 198/550.4

[58] Field of Search ..... 19/90, 96, 97.5, 105, 19/145.5; 198/550.01, 550.4, 550.5, 550.8; 209/245; 414/278

[56] References Cited

U.S. PATENT DOCUMENTS

| | | | |
|---|---|---|---|
| 528,389 | 10/1894 | Potter | 19/97.5 |
| 3,141,199 | 7/1964 | Hilt et al. . | |
| 3,532,099 | 10/1970 | Fuchu et al. | 198/550.4 X |
| 3,738,476 | 6/1973 | Hullett et al. | 19/97.5 |
| 3,889,319 | 6/1975 | Roberson | 19/145 |
| 3,930,285 | 1/1976 | Wornall | 19/105 X |
| 4,043,464 | 8/1977 | Keller et al. | 214/17 |
| 4,165,280 | 8/1979 | Holley | 198/550.8 X |

FOREIGN PATENT DOCUMENTS

| | | | |
|---|---|---|---|
| 1152923 | 8/1963 | Fed. Rep. of Germany . | |
| 0761812 | 10/1980 | U.S.S.R. | 209/245 |

*Primary Examiner*—Werner H. Schroeder
*Assistant Examiner*—John J. Calvert
*Attorney, Agent, or Firm*—Cort Flint

[57] ABSTRACT

A hopper feeder for blending and feeding textile fibers is disclosed which includes a chute (3) having a bottom conveyor belt (5) and an upwardly inclined spiked lattice (6) for reducing and opening the fibers, and inclined surface (4) is disposed in the chute and extends at least half the length of bottom conveyor belt (5), and receives textile fiber from an overhead reciprocating feeder. A freely rotatable roller (11) maintains a column of fibers in working relation with spiked lattice (6). A door (15) is provided below inclined surface (4) through which textile fiber may be fed directly.

12 Claims, 1 Drawing Sheet

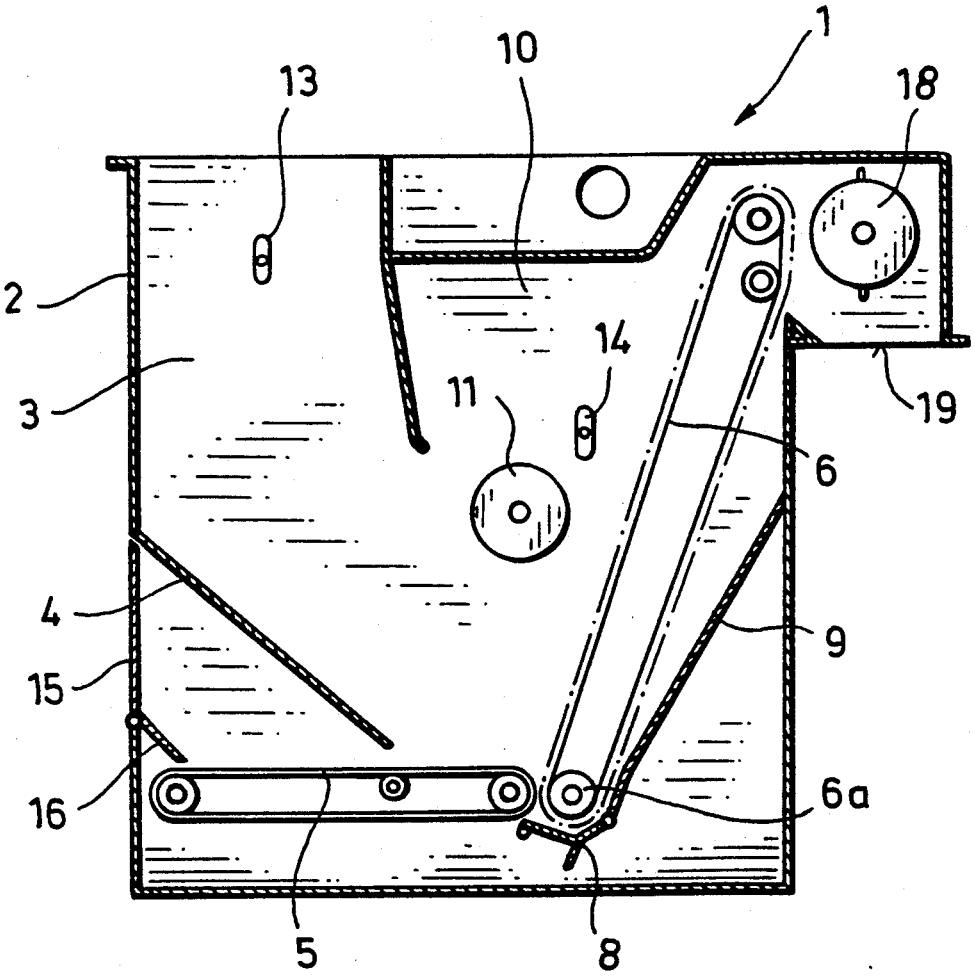
1
10
13
18
2
14
3
11
19
6
4
9
15
16
6a
5
8

HOPPER FEEDER FOR PRODUCING A MIXTURE OF FIBER, MATERIAL, IN PARTICULAR OF TEXTILE FIBER MATERIAL

This is a continuation of PCT application No. PCT/EP 8800871, filed Sept. 28, 1988, which designated and elected the United States.

BACKGROUND OF THE INVENTION

The invention relates to a hopper feeder for producing a mixture of fiber material, in particular of natural or synthetic textile fiber material, e.g. cotton etc., comprising a bottom conveyer belt arranged at the lower edge of the chute and a reduction assembly projecting upwardly from the bottom conveyer belt in the working direction thereof, e.g. an upright spiked lattice (DE-AS 1 152 923).

To obtain a flock blend in the hopper feeder which may be further moved to a processing machine, providing flock guidance in the hopper feeder is of particular importance. Fiber material present in the hopper feeder should be conveyed in such a way that it is deposited in a predetermined manner in the hopper feeder compartment and conveyed to the spiked lattice to provide a uniform transport and processing of the fiber material in the hopper feeder.

U.S. Pat. No. 4,043,464 discloses a device for the opening of fiber bales using a reciprocating pick-up means by which fiber material is plucked upwardly from the bales of a row of bales and the plucked material is fed to a supply container for further processing. The pick-up means is arranged on a sort of traveling crane for reciprocating movement thereof, said traveling crane being displaceable on rails along the row of bales.

U.S. Pat. No. 4,165,280 is directed to a hopper feeder of a known type wherein the material in the hopper feeder is to be cleaned. This hopper feeder is provided with a bottom conveyor belt formed as a slat conveyor, an obliquely arranged upright spiked lattice being provided at the end of the bottom conveyor. The fiber material is supplied from the rear wall of the hopper feeder into the filling chamber and is contained within the filling chamber in non-uniform heaps. For obtaining a cleaning effect, the horizontal slat conveyor is provided with rows of brushes sweeping along under the heap of fibers. The brushes, containing spinnable fibers, cooperate with the spikes arranged on the inclined conveyor. In this manner, spinnable fibers will be taken off the brushes, while short fiber particles and other impurities are separated below the horizontal conveyor and are collected.

In the filling chamber of the hopper feeder of U.S. Pat. No. 4,165,280, a small inclined metal panel is provided closely above the horizontal conveyor for covering the gap above the horizontal conveyor to a position at the rear hopper wall. The conveyed material is accommodated in irregular heaps within the filling chamber of the hopper feeder and is conveyed in this state to the upright reduction assembly from which the fiber material is passed on by a take-off roller.

Accordingly, an object of the invention is to provide a flock guidance in the hopper feeder for obtaining a mixture of flocks in a specific manner.

SUMMARY OF THE INVENTION

The above objective is accomplished according to the invention by transporting the fiber material in the hopper feeder in such a manner that the fiber material is deposited in the chamber of the hopper feeder in a predetermined manner, and is passed on to the spiked lattice while effecting a uniform transport and processing of the fiber material in the hopper feeder. A characteristic of the invention is that there is an inclined surface arranged in a lower part of a textile feeder chute extending in a working direction of a bottom conveyor belt at least a half the length of the bottom conveyor belt. The inclined surface extends above a transition point from the bottom conveyor belt to a reduction assembly. A freely rotatable roller is disposed in the hopper feeder and cooperates with a column of fiber material processed by the upright spiked lattice. A reciprocating feed means feeds fiber material to the chute and effects a sandwich type build-up of the fiber column in the filling chamber of the hopper feeder. By providing an inclined surface, which is directed downwardly at the rear wall of the chute and extends at least half the length of the bottom conveyer belt, the fiber material in the filling chamber of the hopper feeder is influenced in such a manner that the sandwiched form of the fiber column is basically maintained up to the reduction assembly. This arrangement fulfills the purpose of homogenizing and intensifying the flock mixture and unifying the variation of material density, as well as compensating the differences in the humidity of the material. A homogeneity of the mixture of material is necessary to obtain maximum spinning limits and to keep the number of broken fibers extremely low. The freely rotatable roller contributes to maintaining the sandwiched structure of the fiber column. This fiber column with its sandwiched structure, after corresponding displacement by the inclined surface, is supplied by the roller to the upright spiked lattice in an almost vertical orientation. The inclined surface and the roller, in mutual cooperation, serve for maintaining the sandwich structure of the fiber column on its way to the upright spiked lattice. An interruption of the continuous mixing process is prevented. The roller can be adjustable in height. After the roller, light barriers can be provided in the chute above the roller. An openable trough is provided below the lower guide roll for the reduction assembly. The trough can be pivotable. In the rear wall of the hopper housing, an openable window-like wall can be provided beneath the inclined surface.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

The Figure shows an elevational and schematic view of a hopper feeder constructed according to the invention.

DESCRIPTION OF A PREFERRED EMBODIMENT

Referring in more detail to the drawings, a housing 2 of a hopper feeder 1 includes a filling chamber or feed box 3 comprising an inclined surface 4 in a lower portion. Inclined surface 4 serves as a sliding plane for fibers dropping into the box from the reciprocating (not-illustrated) feeding device arranged above the opening of the feed box. Preferably, inclined surface 4 is a sliding plate extending at least half the length of the bottom conveyor belt 5. Inclined surface 4 and bottom conveyor belt 5, which preferably is a bottom lattice, form the ground limitation on which the introduced fiber material may be deposited to form there a sandwich type fiber column. Preferably, bottom lattice 5 is driven via a direct current motor. By this means, a continuous, non-varying reduction and a uniform flock size are ensured.

Bottom conveyor belt 5 is followed by a reduction assembly 6 moving in working direction which is suitably formed by an upright spiked lattice. Beneath a lower guide roll 6a of the upright spiked lattice is a trough 8. Trough 8 may be opened and contaminants such as heavy substances and other impurities present in the fiber material may accumulate in the trough. To this effect, another inclined plate 9 is provided on the rear side of the spiked lattice. Preferably, trough 8 is carried by hinges on plate 9 permitting separated impurities to be removed when the machine is at a standstill.

In a space 10 between feed box 3 and spiked lattice 6 is a roller 11 arranged above a transition from bottom lattice 5 to spiked lattice 6. Roller 11 is not driven but supported to rotate freely. In special cases, a drive can be provided. Roller 11 holds the column of fiber material down when the fiber material is processed by the upright spiked lattice 6. Subject to the prevailing conditions and the kind of fiber material, roller 11 may be adjusted in height.

Preferably, in feed box 3 and in space 10, there are light barriers 13 and 14 which scan the level of the fiber columns. The light barriers control the supply of fiber material to the hopper feeder.

At the rear wall of housing 2, a door or flap 15 may be provided which is situated beneath inclined surface 4. Due to such a flap, smaller fiber material batches may be directly introduced manually into the hopper feeder. To be sure that the material gets directly to the bottom conveyer belt 5, a guide plate 16 may be provided at the underside of door 15.

Upright lattice 6 may be combed out by a stripping roller 18. Fiber flocks released this way are discharged or sucked through opening 19 for further processing.

While a preferred embodiment of the invention has been described using specific terms, such description is for illustrative purposes only, and it is to be understood that changes and variations may be made without departing from the spirit or scope of the following claims.

What is claimed is:

1. A Hopper feeder for producing a mixture of textile fiber material, said hopper feeder being of the type which includes a chute which is fed textile fiber from a reciprocating feed means, a bottom conveyor belt disposed at a lower edge of said chute, and a reduction assembly projecting upwardly from said bottom conveyor belt in a working direction, wherein said feeder comprises an inclined surface disposed in a lower portion of said chute extending from a wall of said chute in said working direction of said bottom conveyor belt, said inclined surface extending downwardly and approximately as far as a half the length of said bottom conveyor belt, said inclined surface terminating above a transition point from said bottom conveyor belt to said reduction assembly, and a freely rotatable roller disposed within a filling chamber of said feeder in working relation with said reduction assembly for acting on a column of fiber material processed by said production assembly.

2. The apparatus of claim 1 wherein said reduction assembly includes an inclined spiked lattice extending upwardly from said bottom conveyor belt.

3. The apparatus of claim 1 wherein said rotatable roller is adjustable in height.

4. The apparatus of claim 1 including an open trough disposed below said reduction assembly.

5. The apparatus of claim 4 wherein said open trough is pivotable, and is disposed below a lower guide roll of said reduction assembly.

6. The apparatus of claim 1 including light barriers disposed in said chute in a space above said freely rotatably roller for sensing the amount of textile fiber in said chute.

7. The apparatus of claim 1 wherein a rear wall of said feeder includes a door disposed below said inclined surface which may be opened for the introduction of textile fiber directly into said feeder.

8. A Hopper feeder for producing a mixture of textile fiber material, said hopper feeder being of the type which includes a chute which is fed textile fiber from a reciprocating feed means, a bottom conveyor belt disposed at a lower edge of said chute, and a reduction assembly projecting upwardly from said bottom conveyor belt in a working direction, wherein said feeder comprises an inclined surface disposed in a lower portion of said chute extending from a wall of said chute in said working direction of said bottom conveyor belt, said inclined surface extending downwardly and approximately as far as a half the length of said bottom conveyor belt, said inclined surface terminating above a transition point from said bottom conveyor belt to said reduction assembly.

9. The apparatus of claim 8 including an open trough disposed below said reduction assembly.

10. The apparatus of claim 8 wherein said open trough is pivotable, and is disposed below a lower guide roll of said reduction assembly.

11. The apparatus of claim 8 including light barriers disposed in said chute in a space above said freely rotatably roller for sensing the amount of textile fiber in said chute.

12. The apparatus of claim 8 wherein a rear wall of said feeder includes a door disposed below said inclined surface which may be opened for the introduction of textile fiber directly into said feeder.

* * * * *